US005901574A

United States Patent [19]

Rohde

[11] Patent Number: 5,901,574

[45] Date of Patent: May 11, 1999

[54] DEVICE AND PROCESS FOR EVAPORATING A LIQUID

[75] Inventor: Wilhelm Rohde, München, Germany

[73] Assignee: Linde Aktiengesellschaft, Germany

[21] Appl. No.: 08/799,962

[22] Filed: Feb. 14, 1997

[30] Foreign Application Priority Data

Feb. 14, 1996 [DE] Germany ..... 196 05 500

[51] Int. Cl.[6] ..... F25J 3/00

[52] U.S. Cl. ..... 62/640; 62/903

[58] Field of Search ..... 62/640, 903

[56] References Cited

U.S. PATENT DOCUMENTS

| | | | |
|---|---|---|---|
| 3,880,231 | 4/1975 | Gauthier | 62/903 X |
| 3,992,168 | 11/1976 | Toyama et al. | 62/903 X |
| 5,071,458 | 12/1991 | Grenier et al. | 62/903 X |
| 5,122,174 | 6/1992 | Sunder et al. | 62/903 X |
| 5,205,351 | 4/1993 | Muller et al. | 62/903 X |
| 5,438,836 | 8/1995 | Srinivasan et al. . | |
| 5,537,840 | 7/1996 | Srinivasan et al. | 62/903 X |
| 5,682,945 | 11/1997 | Lehman | 62/903 X |
| 5,709,264 | 1/1998 | Sweeney et al. | 62/903 X |
| 5,724,834 | 3/1998 | Srinivasan et al. | 62/903 X |

FOREIGN PATENT DOCUMENTS 0 469 780 2/1992 European Pat. Off. .

*Primary Examiner*—Christopher Kilner
*Attorney, Agent, or Firm*—Millen, White, Zelano & Branigan, P.C.

[57] ABSTRACT

The device and the process are used to evaporate a liquid. A first (7) and a second (9) heat exchanger contain evaporation passages and passages for a heat transfer fluid. First heat exchanger (7) is designed as a falling film evaporator, second heat exchanger (9) is designed as a liquid bath evaporator. First heat exchanger (7) has means (13, 14) to introduce heat transfer fluid and means to drain heat transfer fluid. Second heat exchanger (9) includes means to introduce heat transfer fluid. The flow of the means for draining heat transfer fluid from first heat exchanger (7) is connected to the flow of the means for introducing heat transfer fluid into second heat exchanger (9). The equipment and the device can be used in a process for low-temperature separation of air that has a double column consisting of a pressure column (2) and a low-pressure column (3), and the equipment is used for evaporating liquid (5, 6) from the lower section of low-pressure column (3) in indirect heat exchange (7, 9) against condensing vapor (13, 14) from the upper area of pressure column (2).

8 Claims, 2 Drawing Sheets

DEVICE AND PROCESS FOR EVAPORATING A LIQUID

SPECIFICATION

This invention relates to a device and process for evaporating a liquid with successive first and a second heat exchangers, both heat exchangers containing passages for evaporation and passages for a heat transfer fluid, wherein the first heat exchanger is designed as a falling film evaporator and the second heat exchanger is designed as a liquid bath evaporator. The first heat exchanger has separate means to introduce and withdraw heat transfer fluid, and the second heat exchanger has means to introduce heat transfer fluid.

BACKGROUND OF THE INVENTION

In many processes it is necessary to evaporate a liquid in indirect heat exchange with a heat transfer fluid. Heat transfer fluid is understood here to mean any fluid that releases heat, for example a condensing gas. There are two basic forms of such evaporators. Liquid bath evaporators, also called thermosiphon evaporators, stand in a liquid bath, and the evaporation passages are in contact with the liquid bath and the vapor formed exits on top out of the evaporation passages. With falling film evaporators, the liquid flows as a film over the walls of the evaporation passages and thus evaporates partially; the vapor formed flows with the fluid downward and is drained on the lower end of the evaporation passages together with the portion that has remained liquid. Both types have drawbacks. Thus with liquid bath evaporators, the structural height is limited; and with falling film evaporators a pump is needed to circulate liquid because, with the evaporated portion, a certain residual amount of liquid exits that must be circulated. In EP-A469780 it has already been proposed to combine a falling film evaporator and a liquid bath evaporator by connecting them in sequence on the evaporation side. The passages for the heat transfer fluid are arranged in parallel. This device requires a control mechanism that adjusts the distribution of the heat transfer fluid to both of the heat exchangers. For this purpose, at least one pipe must emerge from the housing to a controllable valve. Overall, this proposal results in expensive pipework and a relatively large structural height.

SUMMARY OF THE INVENTION

Thus, an object of the invention is to develop an improved device of the above-mentioned type that is less expensive and more compact.

Another object is to provide a process using the improved device.

Upon further study of the specification and appended claims, further objects and advantages of this invention will become apparent to those skilled in the art.

These objects are achieved by connecting the flow path of the means to withdraw the heat transfer fluid from the first heat exchanger with the flow path of the means to introduce heat transfer fluid into the second heat exchanger. Both heat exchangers thus are serially connected on the heat transfer fluid side and specifically so that the heat transfer fluid first runs through the heat transfer fluid passages of the falling film evaporator and the exit heat transfer fluid is conveyed at least partially, e.g., at least 45%, preferably completely or essentially completely, e.g., at least 80%, to the heat transfer fluid passages of the liquid bath evaporator.

Each of the heat exchangers of the invention can be made from one or several blocks. It is possible, for example, to make the liquid bath evaporator in the form of two or more blocks placed next to one another.

An advantage of an embodiment of the invention is that the distribution of the heat transfer fluid to each heat exchanger does not need to be regulated. The heat transfer fluid passages can be connected directly to one another, for example by a single short pipe. The device according to the invention can thus be produced very economically.

Preferably, according to that aspect of the invention wherein each heat exchanger can be designed as a block, the upper section of the block forms the first heat exchanger and the lower section of the block forms the second heat exchanger. Thereby, it is unnecessary to collect the heat transfer fluid on the lower end of the first heat exchanger (falling film evaporator) and then distribute it again to the heat transfer fluid passages of the second heat exchanger (liquid bath evaporator). In this case, it is advantageous for the block to contain heat transfer fluid passages that run completely or throughout its entire length. The overall device is thus designed on the heat transfer fluid side as a single heat exchanger block that has, for example, the structural shape of a plate-type heat exchanger. Only on the evaporation side, in a transition zone between the first and second heat exchanger, must a liquid-vapor mixture from the heat exchanger block be withdrawn from the falling film evaporator, so that the unvaporized liquid portion flows into the liquid bath and the downwardly flowing vapor is separated therefrom, thereby escaping laterally outside of the transition zone. Simultaneously, in this transition zone, the vapor produced in the evaporation passages of the second heat exchanger (liquid bath evaporator) flowing upwardly therein must be withdrawn laterally from the heat exchanger block. It is to be noted in this connection that the evaporation passages of the first and second exchanger in the transition zone are separated from one another.

Overall, the device can thus be constructed in a very simple and economical way. Special measures to connect the heat transfer fluid passages are eliminated; also the above-described special configurations in the transition area can be achieved without great expense, preferably in an aluminum plate-type heat exchanger.

The invention further relates to a process wherein a liquid is evaporated in the above device.

In a particular embodiment of the invention the device and the process are employed in a double-column to separate air wherein the device is used as a condenser-evaporator (main condenser). The liquid to be evaporated is an oxygen-rich bottom liquid from the low-pressure column and the heat transfer fluid is a nitrogen-rich top gas from the high pressure column, which condenses in the condenser-evaporator.

BRIEF DESCRIPTION OF THE DRAWINGS

Preferred embodiments of the invention are represented in the drawings, wherein.

DETAILED DESCRIPTION OF THE DRAWINGS

Figure 1:
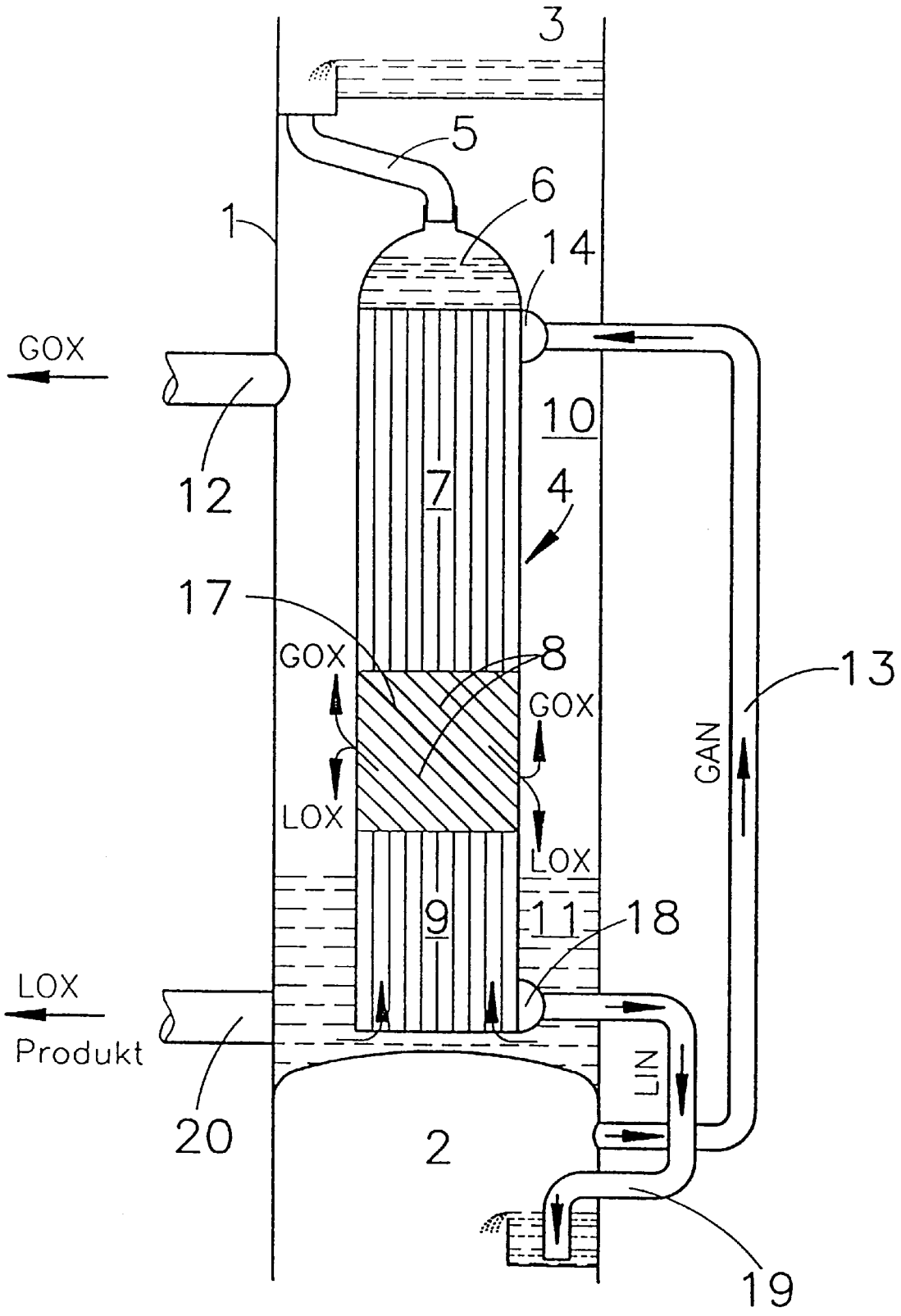
FIG. 1 is a schematic vertical sectional view of a device according to the invention installed in an air separation double column.

In the embodiment of FIG. 1, representing a double column for low-temperature air separation that has a high pressure column 2 and a low-pressure column 3 the housing of the device is formed in the embodiment by jacket 1. (Only the top or bottom area of both columns are represented.) The entire condenser-evaporator is designed as a plate-type heat exchanger block 4. In FIG. 1, only one of the evaporation passages is represented. The vertical lines do not represent walls between various passages but rather the fins inside the one evaporation passage.

Figure 2:
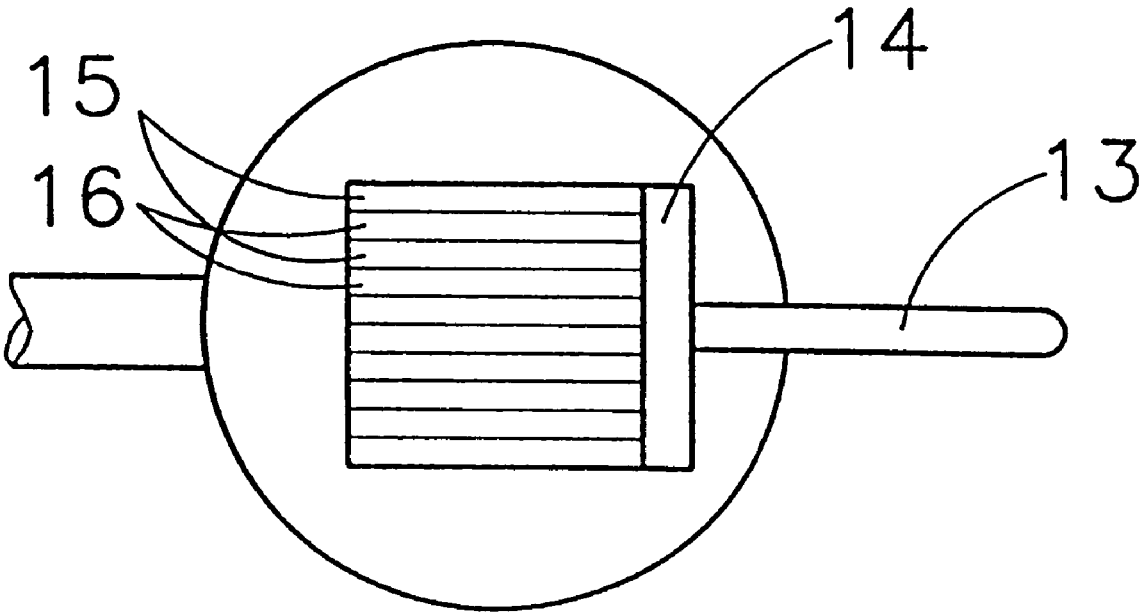
FIG. 2 is a top cross sectional view of the embodiment of FIG. 1.

The arrangement of the passages depicted in cross section, diagrammatically, in FIG. 2 provides evaporation passages 15 and heat transfer fluid passages 16 alternating in layers with one another. The height of the passages (distance between two plates) is, for example, about 2 to 10 mm. The total number of passages arranged next to one another, depending on their height and the diameter of the column, is, for example, 10 to 400.

Referring to FIG. 1, on the top side of the condenser-evaporator, liquid oxygen 5 from low-pressure column 3 is transferred, by a distributor 6, to the liquid passages of the first heat exchanger (falling film evaporator), which is formed by upper section 7 of block 4. In transition area 8, the liquid-vapor mixture is conveyed laterally out of block 4 and flows into outer chamber 10 between block 4 and jacket 1.

Lower part 9 of the same passages forms the evaporation passages of the second heat exchanger that is designed as a liquid bath evaporator. They are open on their lower side and thus connect with a liquid bath 11. Vapor and any entrained liquid flowing upward pass to the transition zone 8 and are withdrawn from block 4 (left in the drawing). A separating strip 17 that separates the first and second heat exchanger from one another runs through each evaporation passage at an angle through the transition zone. This angle is generally about 70 to 25 degrees from the vertical, preferably 60 to 45 degrees.

Part of the vapor formed in both heat exchangers is withdrawn by product line 12; the other part flows into low-pressure column 3. The portion that remains liquid from both heat exchangers falls into liquid bath 11, the latter being the feed for the second heat exchanger 9. There, oxygen can be withdrawn as a liquid by line 20, as needed.

Gaseous nitrogen (13) withdrawn from the top of high pressure column 2 is used as heat transfer fluid. It is supplied by a superposed header 14 to heat transfer fluid passages 16 of first heat exchanger 7. The heat transfer fluid passages (not shown in FIG. 1) run in the embodiment without interruption through the entire height of block 4, i.e., through first heat exchanger 7, transition area 8 and second heat exchanger 9. In any case, the closeness or type of fins can change over the height of the heat transfer fluid passages. After traversing the entire height of block 4, the nitrogen—condensed during heat exchange with the evaporating oxygen—is withdrawn at the lower end of the second heat exchanger 9 from the heat transfer fluid passages into collector 18 and conveyed by line 19 into a receptacle at the top of the high pressure column 2.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

In the foregoing and in the following examples, all temperatures are set forth uncorrected in degrees Celsius and unless otherwise indicated, all parts and percentages are by weight.

The entire disclosure of all applications, patents and publications, cited above and below, and of corresponding German application No. 196 05 500.8, are hereby incorporated by reference.

In a concrete example, the length (vertical extent) of first heat exchanger 7 is 1.7 m, second heat exchanger 9 is 2.8 m long; transition area 8 has a length of 0.6 m vertically, the stacking height of the plates (vertical ones in FIG. 2) equals 1.20 m with a passage height (plate separation distance) of 6 mm.

The condenser-evaporator combines, in one block 4, the functions of two different types of heat exchangers 7, 9. Nevertheless, the production cost is hardly higher than with a conventional plate-type heat exchanger. Whereas the heat transfer fluid passages can be designed completely conventionally, only in transition area 8 of the evaporation passages are additional measures necessary in this example, namely the incorporation of fins running at an angle and a separation strip 17, and the lateral opening of the evaporation passages. Overall, the device provides a very economical and compact arrangement that combines the advantages of falling film evaporators and liquid bath evaporators.

The preceding example can be repeated with similar success by substituting the generically or specifically described configurations and/or operating conditions of this invention for those used in the preceding example.

From the foregoing description, one skilled in the art can easily ascertain the essential characteristics of this invention, and without departing from the spirit and scope thereof, can make various changes and modifications of the invention to adapt it to various usages and conditions.

What is claimed:

1. A device for evaporating a liquid, comprising a first (7) and a second (9) heat exchanger, said heat exchangers (7, 9) being serially connected and containing passages (15) for evaporation and passages (16) for a heat transfer fluid, said first heat exchanger (7) being a falling film evaporator and said second heat exchanger (9) being a liquid bath evaporator, said first heat exchanger (7) having means (13, 14) to introduce said heat transfer fluid and means to withdraw said heat transfer fluid, said second heat exchanger (9) having means to introduce heat transfer fluid, said means for withdrawing heat transfer fluid out of said first heat exchanger (7) being connected to and in communication with the means for introducing heat transfer fluid into the second heat exchanger (9).

2. A device according to claim 1, wherein both heat exchangers (7, 9) are incorporated in a single block (4) having a vertical dimension, an upper section of said block (4) comprising said first heat exchanger (7) and a lower section of said block (4) comprising said second heat exchanger (9).

3. A device according to claim 2, said block (4) having heat transfer fluid passages (16) incorporated throughout essentially the entire vertical dimension of said block (4).

4. A process for evaporating a liquid in indirect heat exchange with a heat transfer fluid, said process comprising introducing liquid to be incorporated (5, 6) into evaporation passages (15) of a first heat exchanger (7), operated as a falling film evaporator, and thereafter into a second heat exchanger (9) operated as a liquid bath evaporator; introducing a heat transfer fluid (13, 14) into heat transfer fluid passages of heat exchanger (7), withdrawing at least part of the heat transfer fluid from the first heat exchanger (7) and introducing said withdrawn heat transfer fluid into heat transfer fluid passage of second heat exchanger (9).

5. A process according to claim 4 incorporated in a process for the low-temperature separation of air in a double column comprising a high pressure column (2) and a low-pressure column (3), wherein liquid (5, 6) from a lower section of the low-pressure column (3) is evaporated in indirect heat exchange (7, 9) against condensing vapor (13, 14) from an upper zone of the high pressure column (2).

6. Apparatus for the low-temperature separation of air comprising a double column comprising a high pressure column (2) and a low-pressure column (3), and said high pressure column (2) and low-pressure column (3) being thermally connected by a common condenser-evaporator (7, 9), wherein said condenser-evaporator (7, 9) is a device according to claim 1.

7. Apparatus for the low-temperature separation of air comprising a double column comprising a high pressure column (2) and a low-pressure column (3), said high pressure column (2) and low-pressure column (3) being thermally connected by a common condenser-evaporator (7, 9), wherein said condenser-evaporator (7, 9) is a device according to claim 2.

8. Apparatus for the low-temperature separation of air comprising a double column comprising a high pressure column (2) and a low-pressure column (3), said high pressure column (2) and low-pressure column (3) being thermally connected by a common condenser-evaporator (7, 9), wherein said condenser-evaporator (7, 9) is a device according to claim 3.

* * * * *